United States Patent [19]

Johnson

[11] Patent Number: 4,896,437

[45] Date of Patent: Jan. 30, 1990

[54] INSULATED BOOT AND GAITER COMBINATION

[76] Inventor: David R. Johnson, 1680 Ponderosa, Murphy's, Calif. 95247

[21] Appl. No.: 785,242

[22] Filed: Oct. 7, 1985

[51] Int. Cl.[4] ..... A41D 17/00

[52] U.S. Cl. ..... 36/1.5; 36/2 R; 2/22

[58] Field of Search ..... 36/1.5, 2 R, 2 A, 2 B, 36/71.5, 72 R; 2/2, 22, DIG. 6, 242, 401, 87, 23, 61, 97, 272

[56] References Cited

U.S. PATENT DOCUMENTS

| | | | |
|---|---|---|---|
| 342,152 | 5/1886 | Welton | 36/2 R |
| 1,285,337 | 11/1918 | O'Bannon | 36/1.5 |
| 1,725,597 | 8/1929 | Rogers | 36/1.5 |
| 1,749,789 | 3/1930 | Wheeler | 36/2 B |
| 3,465,364 | 9/1969 | Edelson | 2/DIG. 6 |
| 3,538,914 | 11/1970 | Myers | 2/DIG. 6 |
| 3,827,167 | 8/1974 | Jones | 36/4 |
| 4,001,953 | 1/1977 | Fugere et al. | 2/22 |
| 4,461,030 | 7/1984 | Knudsen | 36/2 R |
| 4,461,098 | 7/1984 | Diegelman | 36/2 R |
| 4,503,566 | 3/1985 | Wheeler | 36/2 R |
| 4,542,597 | 9/1985 | Baptista et al. | 36/1.5 |

FOREIGN PATENT DOCUMENTS

| | | | |
|---|---|---|---|
| 701594 | 12/1940 | Fed. Rep. of Germany | 2/242 |
| 2433309 | 4/1980 | France | 2/DIG. 6 |
| 219125 | 5/1942 | Switzerland | 2/22 |

*Primary Examiner*—Steven N. Meyers

*Attorney, Agent, or Firm*—Phillips, Moore, Lempio & Finley

[57] ABSTRACT

A light-weight insulated bootie-gaiter combination for cross-country skiers and winter backpackers is disclosed wherein the gaiter is provided with a removable insulating liner along with lower attachment means for engaging the outer surface of a bootie foot cover.

6 Claims, 2 Drawing Sheets

INSULATED BOOT AND GAITER COMBINATION

BACKGROUND OF THE INVENTION

This invention relates to a combination foot-covering bootie and leg-covering gaiter attachable thereto.

The increasing interest in outdoor recreational activities taking place in all four seasons of the year has given rise to new designs and ideas for protective clothing. It is important to an outdoor recreationalist that his clothing be both light-weight and effective in protecting him from the elements. In particular, the cross-country hiker and back-packer along with the cross-country and Nordic skier have requirements that are more critical than that of the daily recreationalist because they must carry all their equipment, including clothing, with them. Thus, the versatility, weight and effectiveness of each item carried by an extended period user of protective equipment is very important.

The long-distance back-packer and skier is particularly concerned with protecting his lower leg and foot region so that he may continue on in safety and comfort to the end of his planned excursion. One item of apparel found especially well suited to protect the ankle region of the user is the conventional insulating gaiter which a recreationalist pulls on over his boots and secures to his calf. The gaiter is a tube having elasticized ends thereon. Upon reaching his destination, the recreationalist removes the gaiter and then removes his boots to then don his alternative footwear.

In practice, the insulating quality of the gaiter is determined by the type and thickness of material used in its manufacture. A recreationalist may carry gaiters of different weight in his pack to cover different environmental conditions. Also, the extended period recreationalist typically includes, in his gear, alternative footwear for use when he has reached his daily destination.

Accordingly, it is an object of the present invention to provide a combination of insulated bootie and gaiter which provides protection and, also, permits detachment therebetween so that the gaiter alone can be used during outdoor activity. An important feature of the present invention is that the bootie and the gaiter are removably attached to provide an integral structure for the wearer's comfort and protection.

In addition, the invention is constructed so as to permit the insertion of an insulating panel into the gaiter thereby essentially eliminating the requirement of different types of gaiters with varied insulating characteristics having to be transported during the cross-country exercise.

A further object is the ease of adding and removing the insulating insert to the gaiter while the user is in the field. Also, the gaiter is designed to permit easy removal from the calf of the user, thus facilitating use of the bootie alone as desired.

SUMMARY OF THE INVENTION

This invention relates to the combination of an insulated bootie and removably attached gaiter for the outdoor recreational enthusiast.

The combination bootie and gaiter commprises a flexible bootie having an opening in which the user places his foot and a gaiter which is designed for placement about the calf of the user immediately adjacent the bootie. The gaiter has an inner surface with its lower edge adjacent the bootie and includes securing means for removably attaching this lower edge about the opening in the bootie whereby the bootie and gaiter form a unitary structure.

An insulating panel is removably affixed to the inner surface of the gaiter. The panel is preferably formed from a moisture impervious material. The bottle, capable of wear without connection to the gaiter, is provided with an upward extension about the opening therein. This upward extension is attached to the lower edge of the gaiter by the securing means at the user's election. Alternatively, the gaiter may be worn by itself, with or without the removable insulating panel when the user has donned other footwear for outdoor activity.

The gaiter is provided with a longitudinal seam opening which extends vertically between the edges of the gaiter. A first fastening meansis affixed to the gaiter adjacent this opening to permit the user to place it on his calf and then close it. Protective means is provided which extends along and overlies the longitudinal seam when the seam opening is in closed position. Thus, the user is able to wrap the gaiter about his calf and then utilize the fastening means to close the longitudinal seam. The protective means overlying this longitudinal seam inhibits the passage of water and cold air through the seam. In addition, the gaiter is provided with a second fastening means for securing this protective means in position overlying the seam further adding to the protection and comfort to the lower leg of the user.

Further features and advantages of the invention will become more readily apparent from the following detailed description of specific embodiments of the invention when taken in conjunction with the accompanying drawings.

DESCRIPTION OF THE PREFERRED EMBODIMENTS

Figure 1:
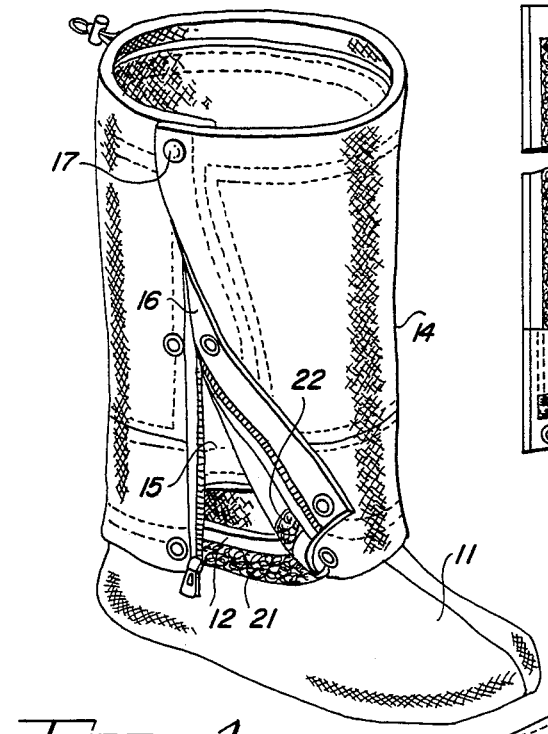
FIG. 1 is a view in perspective of the bootie-gaiter combination.

Referring now to FIG. 1, the subject invention is shown as comprising a foot-covering bootie 11 having a central opening therein to receive the foot of the user. The upper portion of the bootie includes an extension 12 which underlies the lower edge of gaiter 14.

The gaiter 14 includes a longitudinal seam opening containing a fastening means 5 extending therealong. The fastening means is shown as a conventional zipper in the preferred embodiment. The gaiter includes a protective means which extends along and overlies the longitudinal seam opening and is designated as flap 16 in FIG. 1. The flap is secured by second fastening means 17, shown as a series of snap and grommet pairs spaced along the longitudinal seam, which secures and prevents the passage of cold air and water therethrough.

The lower edge of the inner surface of the gaiter 14 contains a fastening strip 22 which engage a mating strip 21 contained on the upward extension 12 of the bootie. The engagement of strips 21 and 22 provides a unitary configuration of bootie and gaiter.

The subject invention in providing an integral bootie-gaiter combination, enables the gaiter used during cross-country activity to be combined with a soft bootie of the same material for wear at the completion of the days exercising or recreational activities. The bootie portion may be independently removed by opening a portion of the longitudinal seam of the gaiter and, since it is manufactured of flexible material, it can be readily stowed in the limited space of a cross-country enthusiast's equipment. The bootie is shown in FIG. 2 with the gaiter in its fully opened position.

Figure 2:
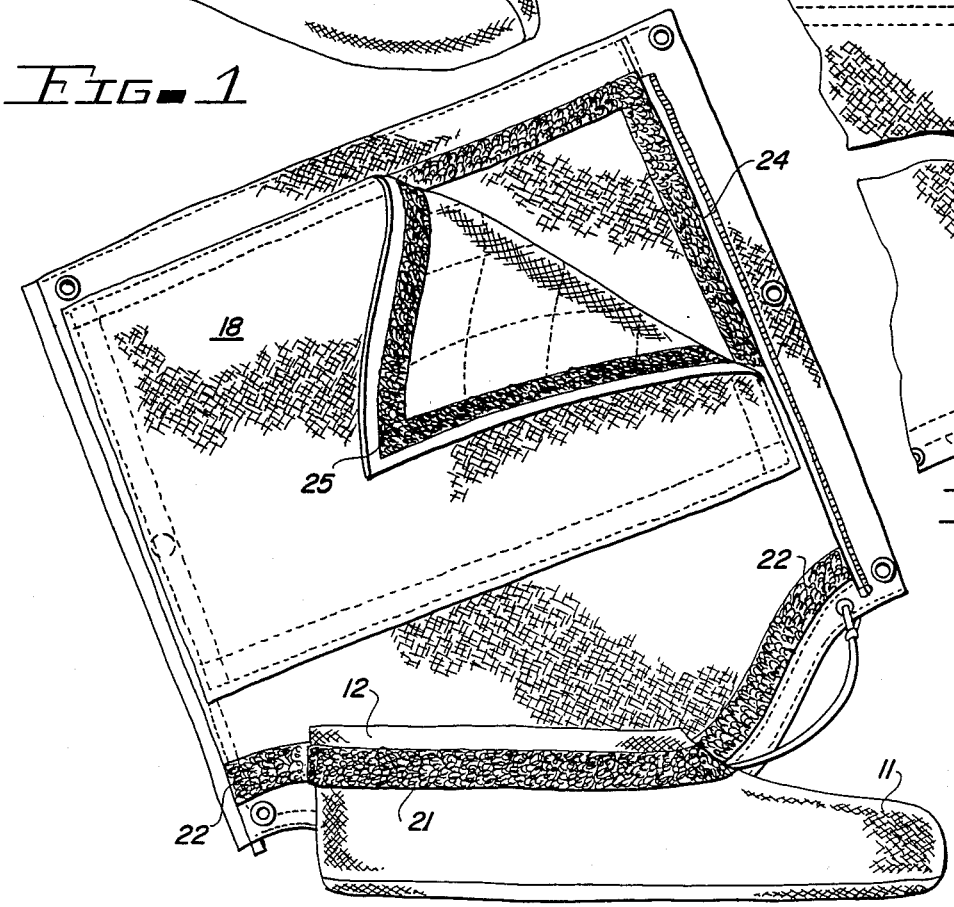
FIG. 2 is a side view of a gaiter in an open position above a bootie.

As shown in FIG. 2, the gaiter 14 includes an insulating panel 18 removably affixed to its inner surface by means of fastening strips 24 and 25. In the preferred embodiment, this substantially rectangular insulating panel is formed from a moisture impervious material. By adding or removing this panel from the gaiter, the user can vary the thermal properties of the gaiter based on the environmental conditions being experienced at that time. When so removed, the insulating panel can be folded into a small volume package and readily stowed in the limited space available to a cross-country outdoor enthusiast. It should be noted that the lower edge of the gaiter contains a curvilinear fastening strip 22 which is secured to its mating strip 21 formed on the upward extension 12 of bootie 11. The strip 22 is curvilinear to permit coverage of the gaiter over the instep of the user while permitting fastening throughout the entire peripheral region of the bootie. Thus, the combination, when assembled, provides a unitary construction for the components of the invention.

Figure 3:
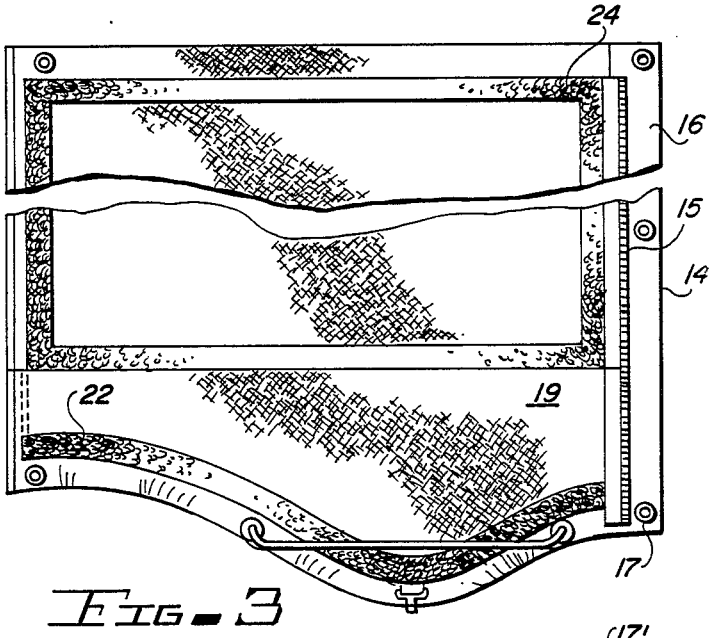
FIG. 3 is a side view of the inner surface of a gaiter with the insulating panel removed.
Figure 4:
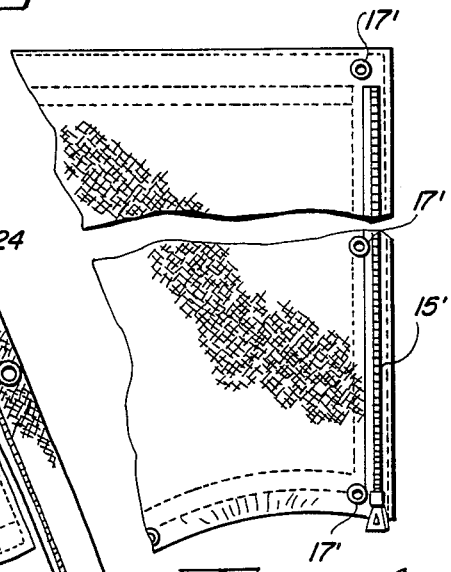
FIG. 4 is a partial side view of FIG. 2 showing the exterior surface of one edge of the longitudinal seam of the gaiter.

The gaiter with the entire panel 18 removed is shown in FIG. 3, wherein the curvilinear aspect of fastening strip 22 is readily observed. In practice, the lower inner surface 19 of the gaiter is formed of the same moisture impervious fabric as is insulating panel 18. This provides protection in the region wherein the gaiter and the bootie are joined by the fastening means. Also, when the gaiter is being used with a conventional hiking boot or cross-country ski boot, the moisture barrier is located at the point where the boot ends to provide moisture protection during athletic activity. The protective flap 16 is shown with the second fastening means 17 along its vertical edge. The first fastening means 15 is shown by the half zipper in FIG. 3. The other half of the zipper 15' is shown in FIG. 4 as being placed on the outer surface of the opposing edge of the gaiter, thereby allowing protective strip 16 to overly the first fastening means. The corresponding portion of the second fastening means is shown as grommets 17' in FIG. 4.

Figure 5:
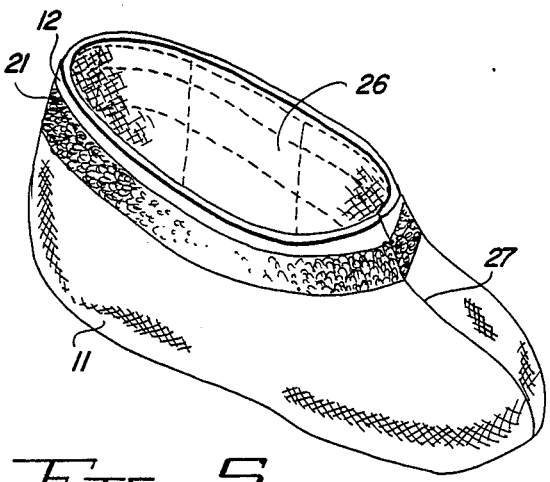
FIG. 5 is a perspective view of a bootie.

The constructional features of the bootie 11, used in combination with the gaiter 14 or for individual use as comfortable slip-on footwear, is shown in FIG. 5 and is formed preferrably from a single blank of material. The blank would be assembled by stitching a front seam 27 and an opposing back seam, not shown, while the sole portion would have no seam. The blank is preferably coated first with an insulating layer 26 of soft comfortable material and stitched at spaced intervals. The opposing surface of the blank contains fastening strip 21 at two locations which would then be joined when the bootie is assembled as shown in FIG. 5.

Figure 7:
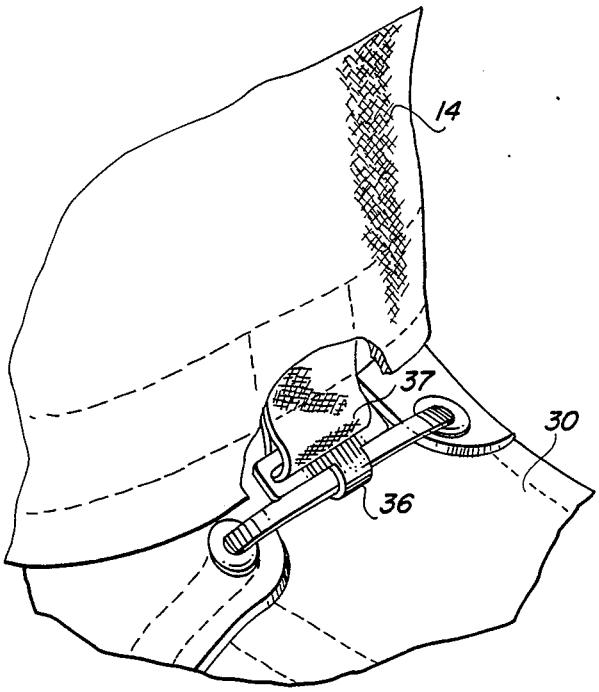
FIGS. 7 and 8 show different retention means used to affect the gaiter to an outdoor boot.
Figure 6:
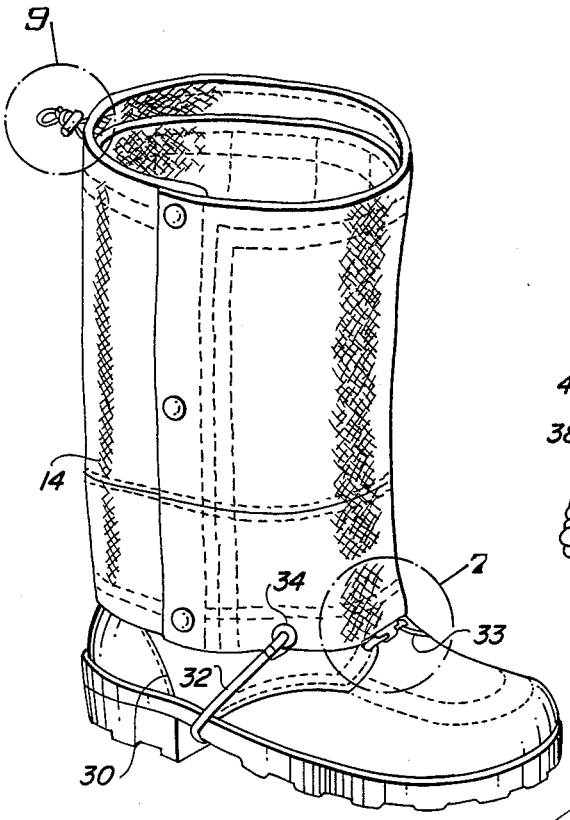
FIG. 6 is a view showing the gaiter in combination with an outdoor boot.
Figure 9:
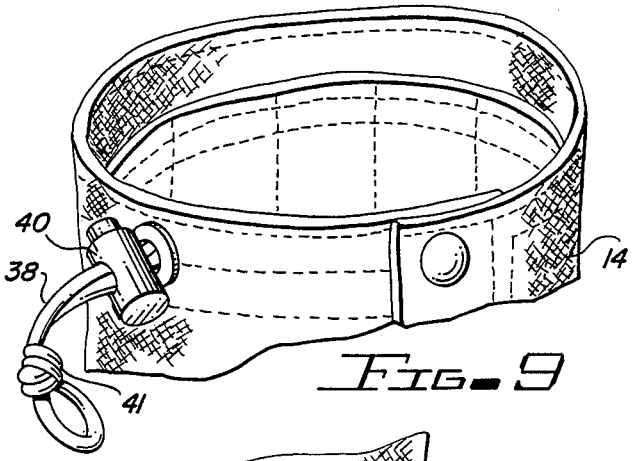
FIG. 9 is a partial view in perspective showing the top edge of the gaiter.
Figure 8:
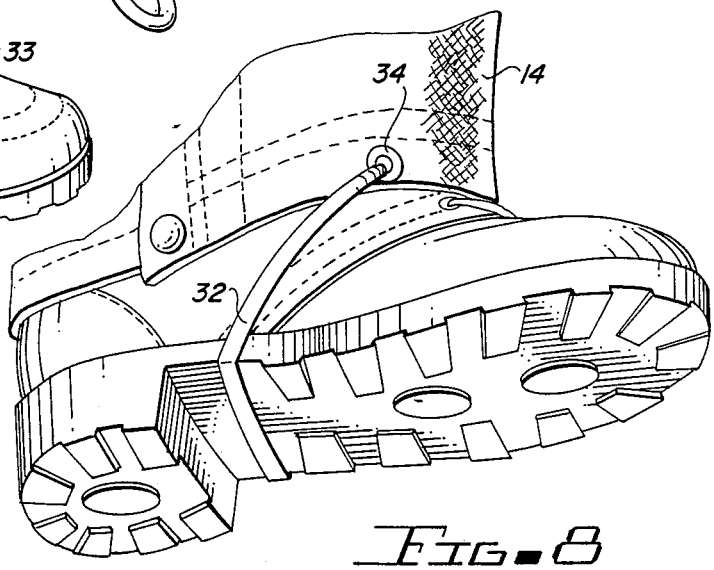

The gaiter 14 is shown being used with a conventional hiking boot 30 in FIG. 6. The gaiter contains two different retention means 32 and 33 which secure it to the hiking boot. Retention means 32 comprises an elastic strap extending between eyelets 34 located in the lower edge of the gaiter. The elastic member is shown extending under the instep of boot 30 and limits the gaiter from moving vertically so as to expose the top of the boot. The second retention means 33 comprises a clip 36 having a frontward extending flange that engages a lace of the hiking boot 30. A strap 37 is sewn on the inner surface of the gaitor above the lower edge thereof and extends downwardly as shown in FIG. 7 and secures clip 37 in its frontward position. In the event the wearer is utilizing a slip-on or unlaced boot, the retention means 32 alone is normally sufficient to limit the vertical movement of the gaiter. The securing strap is shown more clearly in the perspective view of FIG. 8, wherein it extends across the underside of the hiking boot up to a corresponding eyelet on the other side of the gaiter 14.

The top edge of the gaiter 14 is provided with a draw string 38, the free ends of which are fastened to the gaiter at a point adjacent the longitudinal seam therein. When the draw string is tightened, the upper edge of the gaiter is substantially conformed to the calf of the user to prevent snow and rain from entering therebetween. The drawstring 38 is typically formed of an elastic synthetic material and is provided with a locking or tensioning device 40 thereon secured in position by loop 41 of the drawstring.

The versatility of this combination of bootie and gaiter enables the outdoor enthusiast to provide for his footwear requirements with a reduced number of items which he might have to otherwise transport in his knapsack. The insulating bootie is reducible to a small volume for storage as is the insulating panel when removed from the inner surface of the gaiter. After the completion of the athletic activity, the gaiter itself may be continued to be used and fastened to the bootie to form an effective all-weather foot and lower leg protective combination. In the event that neither element of the combination is to be worn, the entire assemblage of components can be readily stowed for transport.

While the foregoing description has referred to a specific embodiment of the invention, it will be recognized that many modifications and variations may be made therein without departing from the scope of the invention as claimed.

What is claimed is:

1. A detachable bootie and gaiter combination comprising:

(a) a bootie having an opening for receiving a foot, said bootie containing an upward extension defining said opening;

(b) a gaiter for placement about the calf of a user, said gaiter having an inner surface including a lower edge positioned adjacent said bootie;

(c) an insulating panel removably affixed to a substantial portion of the inner surface of said gaiter, said panel being spaced from the lower edge of said inner surface;

(d) first fastening means located along a longitudinal seam of said gaiter for effecting removal thereof from the user, said insulating panel being affixed to the inner surface of said gaiter adjacent said first fastening means whereby said panel is adapted to extend around the calf of the user;

(e) protective means extending along and overlying said first fastening means; and (e) securing means affixed to said lower edge of the gaiter for removably attaching said gaiter to the upward extension of said bootie, said bootie and gaiter thereby forming a unitary structure for the protection of the user.

2. The invention of claim 1 wherein said insulating panel is impervious to moisture.

3. A detachable bootie and gaiter combination comprising a bootie conforming to the foot of a user and having an opening therein for receiving the user's foot, said bootie having an upward extension defining said opening and being composed of a soft and flexible thermal insulating material capable of being reduced to a small volume for stowage purposes, a gaiter composed of a soft and flexible material formable into a tube for placement about the calf or the user, said gaiter terminating at a lower edge thereof positioned in overlapping relationship relative to the upward extension of said bootie to fully cover the calf and instep of the user, first fastening means located and extending entirely along the full height of said gaiter for releasably attaching opposite sides thereof together to permit said gaiter to be wrapped and placed about the calf of the user as said tube, second fastening means affixed adjacent to the lower edge of said gaiter and on the upward extension of said bootie for removably attaching said gaiter and bootie together, said bootie and gaiter thereby forming a unitary structure for covering and thermally protecting the calf, instep and foot of the user, a lower inner surface of said gaiter, adjacent to the lower edge thereof, being composed of a moisture impervious fabric to provide a moisture barrier in the region whereat the gaiter and bootie are attached together by said second fastening means, and a soft and flexible thermal insulating panel covering a substantial portion of the inner surface of gaiter between its lower inner surface and an upper edge of said gaiter and also between said first fastening means and means for removably attaching said insulating panel to the inner surface of said gaiter.

4. A gaiter and detachable insulating panel combination comprising a gaiter composed of a soft and flexible material formable into a tube for placement about the calf of a user, said gaiter formed from a flat panel adapted to be wrapped about a calf of a user and have opposite sides thereof adapted to be attached together to form said tube, first fastening means located and extending entirely along the opposite sides of said gaiter for releasably attaching said opposite sides together to form said tube, a soft and flexible thermal-insulating panel covering a substantial portion of an inner surface of said gaiter between the opposite sides thereof, and second fastening means for releasably attaching peripheral sides of said insulating panel to the inner surface of said gaiter.

5. The combination of claim 4 wherein the lower edge of said gaiter is curvillinear and formed to cover an instep of a user and wherein said insulating panel is spaced upwardly from a lower edge of said gaiter and is generally rectangular in configuration.

6. The combination of claim 5 further comprising a bootie composed of a soft and flexible thermal-insulating material and third fastening means for releasably attaching an upper extension of said bootie adjacent to the lower edge of said gaiter.

* * * * *